US010408031B2

(12) United States Patent
Oehring et al.

(10) Patent No.: US 10,408,031 B2
(45) Date of Patent: Sep. 10, 2019

(54) AUTOMATED FRACTURING SYSTEM AND METHOD

(71) Applicant: U.S. Well Services, LLC, Houston, TX (US)

(72) Inventors: Jared Oehring, Houston, TX (US); Brandon N. Hinderliter, Houston, TX (US); Alexander James Christinzio, Morgantown, WV (US)

(73) Assignee: U.S. Well Services, LLC, Houston, TX (US)

( * ) Notice: Subject to any disclaimer, the term of this patent is extended or adjusted under 35 U.S.C. 154(b) by 0 days.

(21) Appl. No.: 16/160,708

(22) Filed: Oct. 15, 2018

(65) Prior Publication Data

US 2019/0112910 A1 Apr. 18, 2019

Related U.S. Application Data

(60) Provisional application No. 62/572,148, filed on Oct. 13, 2017.

(51) Int. Cl.
*E21B 43/26* (2006.01)
*E21B 41/00* (2006.01)
*E21B 21/06* (2006.01)

(52) U.S. Cl.
CPC ..... *E21B 43/26* (2013.01); *E21B 21/062* (2013.01); *E21B 41/0092* (2013.01)

(58) Field of Classification Search
CPC ..... E21B 43/26
See application file for complete search history.

(56) References Cited

U.S. PATENT DOCUMENTS 1,671,436 A 5/1928 Melott
2,004,077 A 6/1935 McCartney
(Continued)

FOREIGN PATENT DOCUMENTS

AU 2007340913 7/2008
CA 2955706 10/2012
(Continued)

OTHER PUBLICATIONS

UK Power Networks—Transformers to Supply Heat to Tate Modern—from Press Releases May 16, 2013.
(Continued)

*Primary Examiner* — Kenneth L Thompson
(74) *Attorney, Agent, or Firm* — Hogan Lovells US LLP

(57) ABSTRACT

An automated hydraulic fracturing system, including a pump system, a blender configured to form the fracturing fluid, a proppant storage and delivery system, a hydration unit configured to mix an additive into a fluid to form the fluid mixture and provide the fluid mixture to the blender, a fluid storage and delivery system, and an additive storage and delivery system, and an automated control system including a plurality of sensing devices and a plurality of control devices integrated into the pump system, the blender system, the proppant storage and delivery system, the fluid storage and delivery system, and the additive storage and delivery system, the automated control system configured to monitor parameters of the automated hydraulic fracturing system via the plurality of sensing devices and transmit control instructions for one or more of the plurality of control devices to control an aspect of the automated hydraulic fracturing system.

8 Claims, 6 Drawing Sheets

(56) References Cited

U.S. PATENT DOCUMENTS 2,183,364 A 12/1939 Bailey
2,220,622 A 11/1940 Aitken
2,248,051 A 7/1941 Armstrong
2,753,940 A 7/1956 Bonner
3,061,039 A 10/1962 Peters
3,066,503 A 12/1962 Fleming
3,334,495 A 8/1967 Jensen
3,722,595 A 3/1973 Kiel
3,764,233 A 10/1973 Strickland
3,773,140 A 11/1973 Mahajan
3,837,179 A 9/1974 Barth
3,849,662 A 11/1974 Blaskowski
3,881,551 A 5/1975 Terry
4,037,431 A 7/1977 Sugimoto
4,100,822 A 7/1978 Rosman
4,151,575 A 4/1979 Hogue
4,226,299 A 10/1980 Hansen
4,265,266 A 5/1981 Kierbow et al.
4,432,064 A * 2/1984 Barker ..... E21B 33/13 175/40
4,442,665 A 4/1984 Fick et al.
4,456,092 A 6/1984 Kubozuka
4,506,982 A 3/1985 Smithers et al.
4,512,387 A 4/1985 Rodriguez
4,529,887 A 7/1985 Johnson
4,538,916 A 9/1985 Zimmerman
4,676,063 A 6/1987 Goebel et al.
4,793,386 A 12/1988 Sloan
4,845,981 A 7/1989 Pearson
4,922,463 A 5/1990 Del Zotto et al.
5,006,044 A 4/1991 Walker, Sr.
5,025,861 A 6/1991 Huber et al.
5,130,628 A 7/1992 Owen
5,131,472 A 7/1992 Dees et al.
5,189,388 A 2/1993 Mosley
5,422,550 A 6/1995 McClanahan
5,548,093 A 8/1996 Sato
5,590,976 A 1/1997 Kilheffer et al.
5,655,361 A 8/1997 Kishi
5,736,838 A 4/1998 Dove et al.
5,790,972 A 8/1998 Kohlenberger
5,865,247 A 2/1999 Paterson
5,879,137 A 3/1999 Yie
5,894,888 A 4/1999 Wiemers
5,907,970 A 6/1999 Havlovick et al.
6,138,764 A 10/2000 Scarsdale et al.
6,142,878 A 11/2000 Barin
6,164,910 A 12/2000 Mayleben
6,202,702 B1 3/2001 Ohira
6,208,098 B1 3/2001 Kume
6,254,462 B1 7/2001 Kelton
6,271,637 B1 8/2001 Kushion
6,315,523 B1 11/2001 Mills
6,477,852 B2 11/2002 Dodo
6,491,098 B1 12/2002 Dallas
6,529,135 B1 3/2003 Bowers et al.
6,776,227 B2 8/2004 Beida
6,802,690 B2 10/2004 Han
6,808,303 B2 10/2004 Fisher
6,931,310 B2 8/2005 Shimizu et al.
7,104,233 B2 9/2006 Ryczek et al.
7,170,262 B2 1/2007 Pettigrew
7,173,399 B2 2/2007 Sihler
7,312,593 B1 12/2007 Streicher et al.
7,336,514 B2 2/2008 Amarillas
7,445,041 B2 11/2008 O'Brien
7,494,263 B2 2/2009 Dykstra et al.
7,500,642 B2 3/2009 Cunningham
7,525,264 B2 4/2009 Dodge
7,563,076 B2 7/2009 Brunet
7,675,189 B2 3/2010 Grenier
7,683,499 B2 3/2010 Saucier
7,717,193 B2 5/2010 Egilsson et al.
7,755,310 B2 7/2010 West et al.
7,807,048 B2 10/2010 Collette
7,845,413 B2 12/2010 Shampine et al.
7,977,824 B2 7/2011 Halen et al.
8,037,936 B2 10/2011 Neuroth
8,054,084 B2 11/2011 Schulz et al.
8,083,504 B2 12/2011 Williams
8,096,891 B2 1/2012 Lochtefeld
8,139,383 B2 3/2012 Efraimsson
8,146,665 B2 4/2012 Neal
8,154,419 B2 4/2012 Daussin et al.
8,232,892 B2 7/2012 Overholt et al.
8,261,528 B2 9/2012 Chillar
8,272,439 B2 9/2012 Strickland
8,310,272 B2 11/2012 Quarto
8,354,817 B2 1/2013 Yeh et al.
8,474,521 B2 7/2013 Kajaria
8,534,235 B2 9/2013 Chandler
8,573,303 B2 11/2013 Kerfoot
8,596,056 B2 12/2013 Woodmansee
8,616,274 B2 12/2013 Belcher et al.
8,692,408 B2 4/2014 Zhang et al.
8,727,068 B2 5/2014 Bruin
8,760,657 B2 6/2014 Pope
8,774,972 B2 7/2014 Rusnak et al.
8,789,601 B2 7/2014 Broussard
8,807,960 B2 8/2014 Stephenson
8,838,341 B2 9/2014 Kumano
8,851,860 B1 10/2014 Mail
8,857,506 B2 10/2014 Stone, Jr.
8,899,940 B2 12/2014 Laugemors
8,905,056 B2 12/2014 Kendrick
8,905,138 B2 12/2014 Lundstedt et al.
8,997,904 B2 4/2015 Cryer
9,018,881 B2 4/2015 Mao et al.
9,051,822 B2 6/2015 Ayan
9,067,182 B2 6/2015 Nichols
9,103,193 B2 8/2015 Coli
9,121,257 B2 9/2015 Coli et al.
9,140,110 B2 9/2015 Coli et al.
9,160,168 B2 10/2015 Chapel
9,175,554 B1 11/2015 Watson
9,206,684 B2 12/2015 Parra
9,322,239 B2 4/2016 Angeles Boza et al.
9,366,114 B2 6/2016 Coli et al.
9,410,410 B2 8/2016 Broussard et al.
9,450,385 B2 9/2016 Kristensen
9,458,687 B2 10/2016 Hallundbaek
9,475,020 B2 10/2016 Coli et al.
9,475,021 B2 10/2016 Coli et al.
9,534,473 B2 1/2017 Morris et al.
9,562,420 B2 2/2017 Morris et al.
9,587,649 B2 3/2017 Oehring
9,611,728 B2 4/2017 Oehring
9,650,871 B2 5/2017 Oehring et al.
9,650,879 B2 5/2017 Broussard et al.
9,738,461 B2 8/2017 DeGaray
9,745,840 B2 8/2017 Oehring et al.
9,840,901 B2 12/2017 Oehring et al.
9,863,228 B2 1/2018 Shampine et al.
9,893,500 B2 2/2018 Oehring
9,970,278 B2 5/2018 Broussard
9,995,218 B2 6/2018 Oehring
10,020,711 B2 7/2018 Oehring
10,036,238 B2 7/2018 Oehring
10,107,086 B2 10/2018 Oehring
10,119,381 B2 11/2018 Oehring
2002/0169523 A1 11/2002 Ross et al.
2003/0138327 A1 7/2003 Jones et al.
2004/0040746 A1 3/2004 Niedermayr
2004/0102109 A1 5/2004 Crafty et al.
2005/0116541 A1 6/2005 Seiver
2005/0274508 A1 12/2005 Folk
2006/0052903 A1 3/2006 Bassett
2006/0260331 A1 11/2006 Andreychuk
2007/0131410 A1 6/2007 Hill
2007/0187163 A1 8/2007 Cone
2007/0201305 A1 8/2007 Heilman et al.
2007/0226089 A1 9/2007 DeGaray et al.
2007/0277982 A1 12/2007 Shampine
2007/0278140 A1 12/2007 Mallet et al.

(56) References Cited

U.S. PATENT DOCUMENTS

2008/0112802 A1 5/2008 Orlando
2008/0137266 A1 6/2008 Jensen
2008/0208478 A1 8/2008 Ella et al.
2008/0217024 A1 9/2008 Moore
2008/0236818 A1 10/2008 Dykstra
2008/0264640 A1 10/2008 Eslinger
2008/0264649 A1 10/2008 Crawford
2009/0045782 A1 2/2009 Datta
2009/0065299 A1 3/2009 Vito
2009/0078410 A1 3/2009 Krenek et al.
2009/0090504 A1 4/2009 Weightman
2009/0093317 A1 4/2009 Kajiwara et al.
2009/0095482 A1 4/2009 Surjaatmadja
2009/0153354 A1 6/2009 Daussin et al.
2009/0188181 A1 7/2009 Forbis
2009/0200035 A1 8/2009 Bjerkreim et al.
2009/0260826 A1 10/2009 Sherwood
2009/0308602 A1 12/2009 Bruins et al.
2010/0000508 A1 1/2010 Chandler
2010/0019574 A1 1/2010 Baldassarre et al.
2010/0051272 A1 3/2010 Loree et al.
2010/0101785 A1 4/2010 Khvoshchev
2010/0132949 A1 6/2010 DeFosse et al.
2010/0146981 A1 6/2010 Motakef
2010/0172202 A1 7/2010 Borgstadt
2010/0200224 A1 8/2010 Nguete
2010/0250139 A1 9/2010 Hobbs et al.
2010/0293973 A1 11/2010 Erickson
2010/0303655 A1 12/2010 Scekic
2010/0322802 A1 12/2010 Kugelev
2011/0005757 A1 1/2011 Hebert
2011/0017468 A1 1/2011 Birch et al.
2011/0061855 A1 3/2011 Case et al.
2011/0085924 A1 4/2011 Shampine
2011/0166046 A1 7/2011 Weaver
2011/0247878 A1 10/2011 Rasheed
2011/0272158 A1 11/2011 Neal
2012/0018016 A1 1/2012 Gibson
2012/0085541 A1 4/2012 Love et al.
2012/0127635 A1 5/2012 Grindeland
2012/0205301 A1 8/2012 McGuire et al.
2012/0205400 A1 8/2012 DeGaray et al.
2012/0232728 A1 9/2012 Karimi et al.
2012/0255734 A1 10/2012 Coli et al.
2013/0009469 A1 1/2013 Gillett
2013/0025706 A1 1/2013 DeGaray et al.
2013/0175038 A1 7/2013 Conrad
2013/0175039 A1 7/2013 Guidry
2013/0199617 A1 8/2013 DeGaray et al.
2013/0233542 A1 9/2013 Shampine
2013/0306322 A1 11/2013 Sanborn et al.
2013/0341029 A1 12/2013 Roberts et al.
2013/0343858 A1 12/2013 Flusche
2014/0000899 A1 1/2014 Nevison
2014/0010671 A1 1/2014 Cryer et al.
2014/0054965 A1 2/2014 Jain
2014/0095114 A1* 4/2014 Thomeer ..... G06Q 10/20 702/187
2014/0096974 A1 4/2014 Coli
2014/0124162 A1 5/2014 Leavitt
2014/0138079 A1 5/2014 Broussard et al.
2014/0174717 A1 6/2014 Broussard et al.
2014/0246211 A1 9/2014 Guidry et al.
2014/0251623 A1 9/2014 Lestz et al.
2014/0277772 A1 9/2014 Lopez
2014/0290768 A1 10/2014 Randle
2014/0379300 A1 12/2014 Devine et al.
2015/0068724 A1 3/2015 Coli et al.
2015/0068754 A1 3/2015 Coli et al.
2015/0075778 A1 3/2015 Walters
2015/0083426 A1 3/2015 Lesko
2015/0097504 A1 4/2015 Lamascus
2015/0114652 A1 4/2015 Lestz
2015/0144336 A1 5/2015 Hardin et al.
2015/0159911 A1 6/2015 Holt
2015/0175013 A1 6/2015 Cryer et al.
2015/0176386 A1 6/2015 Castillo et al.
2015/0211524 A1 7/2015 Broussard
2015/0217672 A1* 8/2015 Shampine ..... E21B 43/26 137/899.4
2015/0225113 A1 8/2015 Lungu
2015/0252661 A1 9/2015 Glass
2015/0300145 A1 10/2015 Coli et al.
2015/0314225 A1 11/2015 Coli et al.
2015/0330172 A1 11/2015 Allmaras
2016/0032703 A1 2/2016 Broussard et al.
2016/0102537 A1 4/2016 Lopez
2016/0105022 A1 4/2016 Oehring
2016/0208592 A1 4/2016 Oehring
2016/0160889 A1 6/2016 Hoffman et al.
2016/0177675 A1 6/2016 Morris et al.
2016/0177678 A1 6/2016 Morris
2016/0186531 A1 6/2016 Harkless et al.
2016/0208593 A1 7/2016 Coli et al.
2016/0208594 A1 7/2016 Coli et al.
2016/0208595 A1 7/2016 Tang
2016/0221220 A1 8/2016 Paige
2016/0230524 A1 8/2016 Dumoit
2016/0230525 A1 8/2016 Lestz et al.
2016/0258267 A1 9/2016 Payne
2016/0273328 A1 9/2016 Oehring
2016/0290114 A1 10/2016 Oehring
2016/0312108 A1 10/2016 Lestz et al.
2016/0319650 A1 11/2016 Oehring
2016/0326854 A1 11/2016 Broussard
2016/0326855 A1 11/2016 Coli et al.
2016/0341281 A1 11/2016 Brunvold et al.
2016/0348479 A1 12/2016 Oehring
2016/0349728 A1 12/2016 Oehring
2016/0369609 A1 12/2016 Morris et al.
2017/0021318 A1 1/2017 McIver et al.
2017/0022788 A1 1/2017 Oehring et al.
2017/0022807 A1 1/2017 Dursun
2017/0028368 A1 2/2017 Oehring et al.
2017/0030177 A1 2/2017 Oehring et al.
2017/0030178 A1 2/2017 Oehring et al.
2017/0036178 A1 2/2017 Coli et al.
2017/0037717 A1 2/2017 Oehring
2017/0037718 A1 2/2017 Coli et al.
2017/0051732 A1 2/2017 Hemandez et al.
2017/0096885 A1 4/2017 Oehring
2017/0104389 A1 4/2017 Morris et al.
2017/0114625 A1 4/2017 Norris
2017/0145918 A1 5/2017 Oehring
2017/0218843 A1 8/2017 Oehring
2017/0222409 A1 8/2017 Oehring
2017/0226839 A1 8/2017 Broussard
2017/0226842 A1 8/2017 Omont et al.
2017/0241221 A1 8/2017 Seshadri
2017/0259227 A1 9/2017 Morris et al.
2017/0292513 A1* 10/2017 Haddad ..... E21B 41/0092
2017/0313499 A1 11/2017 Hughes et al.
2017/0314380 A1 11/2017 Oehring
2017/0328179 A1* 11/2017 Dykstra ..... E21B 43/26
2017/0369258 A1 12/2017 DeGaray
2018/0038216 A1 2/2018 Zhang
2018/0156210 A1 6/2018 Oehring
2018/0183219 A1 6/2018 Oehring
2018/0258746 A1 9/2018 Broussard
2018/0274446 A1 9/2018 Oehring
2018/0320483 A1 11/2018 Zhang
2019/0003329 A1 1/2019 Morris

FOREIGN PATENT DOCUMENTS

CA 2966672 10/2012
CA 2833711 5/2014
CA 2964593 10/2017
CN 201687513 12/2010
CN 101977016 2/2011
CN 202023547 11/2011
CN 102602322 7/2012

(56) References Cited

FOREIGN PATENT DOCUMENTS

| | | |
|---|---|---|
| JP | 2004264589 | 9/2004 |
| WO | 2016/144939 | 9/2016 |
| WO | 2016/160458 | 10/2016 |

OTHER PUBLICATIONS

Non-Final Office Action issued in corresponding U.S. Appl. No. 15/293,681 dated Feb. 16, 2017.
Non-Final Office Action issued in corresponding U.S. Appl. No. 15/294,349 dated Mar. 14, 2017.
Final Office Action issued in corresponding U.S. Appl. No. 15/145,491 dated Jan. 20, 2017.
Non-Final Office Action issued in corresponding U.S. Appl. No. 15/145,443 dated Feb. 7, 2017.
Notice of Allowance issued in corresponding U.S. Appl. No. 15/217,040 dated Mar. 28, 2017.
Notice of Allowance issued in corresponding U.S. Appl. No. 14/622,532 dated Mar. 27, 2017.
Non-Final Office Action issued in corresponding U.S. Appl. No. 15/291,842 dated Jan. 6, 2017.
Final Office Action issued in corresponding U.S. Appl. No. 14/622,532 dated Dec. 7, 2016.
Non-Final Office Action issued in corresponding U.S. Appl. No. 14/622,532 dated May 17, 2016.
Final Office Action issued in corresponding U.S. Appl. No. 14/622,532 dated Dec. 21, 2015.
Non-Final Office Action issued in corresponding U.S. Appl. No. 14/622,532 dated Aug. 5, 2015.
Non-Final Office Action issued in corresponding U.S. Appl. No. 15/145,491 dated Sep. 12, 2016.
Non-Final Office Action issued in corresponding U.S. Appl. No. 15/217,040 dated Nov. 29, 2016.
Non-Final Office Action issued in corresponding U.S. Appl. No. 15/235,788 dated Dec. 14, 2016.
Non-Final Office Action issued in corresponding U.S. Appl. No. 15/145,491 dated May 15, 2017.
Non-Final Office Action issued in corresponding U.S. Appl. No. 15/486,970 dated Jun. 22, 2017.
Non-Final Office Action issued in corresponding U.S. Appl. No. 15/487,656 dated Jun. 23, 2017.
Non-Final Office Action issued in corresponding U.S. Appl. No. 15/487,694 dated Jun. 26, 2017.
Final Office Action issued in corresponding U.S. Appl. No. 15/294,349 dated Jul. 6, 2017.
Non-Final Office Action issued in corresponding U.S. Appl. No. 14/884,363 dated Sep. 5, 2017.
Final Office Action issued in corresponding U.S. Appl. No. 15/145,491 dated Sep. 6, 2017.
Non-Final Office Action issued in corresponding U.S. Appl. No. 14/881,535 dated Oct. 6, 2017.
Non-Final Office Action issued in corresponding U.S. Appl. No. 15/145,414 dated Nov. 29, 2017.
Non-Final Office Action issued in corresponding U.S. Appl. No. 15/644,487 dated Nov. 13, 2017.
Canadian Office Action dated Mar. 2, 2018 in related Canadian Patent Application No. 2,833,711.
Office Action dated Apr. 10, 2018 in related U.S. Appl. No. 15/294,349.
Office Action dated Apr. 2, 2018 in related U.S. Appl. No. 15/183,387.
Office Action dated May 29, 2018 in related U.S. Appl. No. 15/235,716.
Candian Office Action dated Apr. 18, 2018 in related Canadian Patent Application No. 2,928,711.
Canadian Office Action dated Jun. 22, 2018 in related Canadian Patent Application No. 2,886,697.
Office Action dated Jul. 25, 2018 in related U.S. Appl. No. 15/644,487.
Office Action dated Oct. 4, 2018 in related U.S. Appl. No. 15/217,081.
International Search Report and Written Opinion dated Sep. 19, 2018 in related PCT Patent Application No. PCT/US2018/040683.
Canadian Office Action dated Sep. 28, 2018 in related Canadian Patent Application No. 2,945,281.
International Search Report and Written Opinion dated Jan. 4, 2019 in related PCT Patent Application No. PCT/US18/57539.
International Search Report and Written Opinion dated Jan. 2, 2019 in related PCT Patent Application No. PCT/US18/54542.
International Search Report and Written Opinion dated Jan. 2, 2019 in related PCT Patent Application No. PCT/US18/54548.
International Search Report and Written Opinion dated Dec. 31, 2018 in related PCT Patent Application No. PCT/US18/55913.
International Search Report and Written Opinion dated Apr. 10, 2019 in corresponding PCT Application No. PCT/US2019/016635.
Notice of Allowance dated Apr. 23, 2019 in corresponding U.S. Appl. No. 15/635,028.
Schlumberger, "Jet Manual 23, Fracturing Pump Units, SPF/SPS-343, Version 1.0," Jan. 31, 2007, 68 pages.
Stewart & Stevenson, "Stimulation Systems," 2007, 20 pages.
Luis Gamboa, "Variable Frequency Drives in Oil and Gas Pumping Systems," Dec. 17, 2011, 5 pages.
"Griswold Model 811 Pumps: Installation, Operation and Maintenance Manual, ANSI Process Pump," 2010, 60 pages.
Non-Final Office Action dated Feb. 12, 2019 in related U.S. Appl. No. 16/170,695.
International Search Report and Written Opinion dated Feb. 15, 2019 in related PCT Application No. PCT/US18/63977.
Non-Final Office Action dated Feb. 25, 2019 in related U.S. Appl. No. 16/210,749.
International Search Report and Written Opinion dated Mar. 5, 2019 in related PCT Application No. PCT/US18/63970.
Non-Final Office Action dated Mar. 6, 2019 in related U.S. Appl. No. 15/183,387.
Office Action dated Mar. 1, 2019 in related Canadian Patent Application No. 2,943,275.
Office Action dated Jan. 30, 2019 in related Canadian Patent Application No. 2,936,997.

* cited by examiner

AUTOMATED FRACTURING SYSTEM AND METHOD

CROSS REFERENCE TO RELATED APPLICATIONS

This application claims priority to and the benefit of co-pending U.S. Provisional Application Ser. No. 62/572,148 filed Oct. 13, 2017 titled "AUTOMATED FRACTURING SYSTEM" the full disclosure of which is hereby incorporated herein by reference in its entirety for all purposes.

BACKGROUND

With advancements in technology over the past few decades, the ability to reach unconventional sources of hydrocarbons has tremendously increased. Horizontal drilling and hydraulic fracturing are two such ways that new developments in technology have led to hydrocarbon production from previously unreachable shale formations. Hydraulic fracturing (fracturing) operations typically require powering numerous components in order to recover oil and gas resources from the ground. For example, hydraulic fracturing usually includes pumps that inject fracturing fluid down the wellbore, blenders that mix proppant into the fluid, cranes, wireline units, and many other components that all must perform different functions to carry out fracturing operations.

Conventionally, these components or systems of components are generally independent systems that are individually controlled by operators. Furthermore, in some cases, operators are also responsible for taking measurements, interpreting raw data, making calculations, and the like. Thus, a large amount of operator intervention to diagnose, interpret, respond to, adjust, and otherwise control operating conditions of the various components.

SUMMARY

Applicant recognized the problems noted above herein and conceived and developed embodiments of systems and methods, according to the present disclosure, for assessing flow rates in hydraulic fracturing systems.

In an embodiment, an automated hydraulic fracturing system includes a pump system fluidly coupled to a wellhead to pump a fracturing fluid into the wellhead, wherein the pump is instrumented with a pump sensor and a pump controller. The hydraulic fracturing system further includes a blender system fluidly coupled to the pump, the blender mixing together one or more materials to form the fracturing fluid, wherein the blender is instrumented with a blender sensor and a blender controller, and a source system for providing at least one of the one or more materials to the blender, wherein the source is instrumented with a source sensor and a source controller. The hydraulic fracturing system also includes another component, the component instrumented with at least one of a component sensor and a component controller. At least one of the pump controller, blender controller, the source controller, or the component controller controls a respective aspect of the automated hydraulic fracturing system based at least in part on automated instructions, the automated instructions generated based on measurements received from at least one of the pump sensor, the blender sensor, the source sensor, or the component sensor.

In an embodiment, an automated hydraulic fracturing system includes a pump system fluidly coupled to a wellhead at a wellsite to pump a fracturing fluid into the wellhead, a blender configured to mix together proppant and a fluid mixture to form the fracturing fluid, a proppant storage and delivery system configured to provide the proppant for the blender, a hydration unit configured to mix an additive into a fluid to form the fluid mixture and provide the fluid mixture to the blender, a fluid storage and delivery system configured to provide the fluid for the hydration unit, an additive storage and delivery system configured to provide the additive to the hydration unit, and an automated control system including a plurality of sensing devices and a plurality of control devices integrated into the pump system, the blender system, the proppant storage and delivery system, the fluid storage and delivery system, and the additive storage and delivery system, the automated control system configured to monitor one or more parameters of the automated hydraulic fracturing system via the plurality of sensing devices and transmit control instructions for one or more of the plurality of control devices to control an aspect of the automated hydraulic fracturing system.

In an embodiment, an automated hydraulic fracturing method includes initiating a hydraulic fracturing operation using an automated hydraulic fracturing system, providing a first material for a fracturing fluid from a first source to a blender, the first source including a source sensor for measuring one or more parameters associated with the first source and a source controller for controlling one or more functions of the first source, providing a second material for the fracturing fluid from a second source to the blender, mixing the first material and the second material at the blender to form the fracturing fluid, the blender including a blender sensor for measuring one or more parameters associated with the blender and a blender controller for controlling one or more functions of the bender, providing the fracturing fluid from the blender to a pump, the pump including a pump sensor for measuring one or more parameters associated with the pump and a pump controller for controlling one or more functions of the pump, injecting the fracturing fluid from the pump into a wellhead coupled to a well, monitoring the one or more parameters via the source sensor, the blender sensor, and the pump sensor, generating automated instructions for at least one of the source controller, the blender controller, or the pump controller based at last in part on the one or more parameters, and controlling at least one of the one or more functions of the first source, the blender, or the pump via the source controller, the blender controller, or the pump controller, respectively, based at least in part on the automated instructions.

BRIEF DESCRIPTION OF DRAWINGS

The foregoing aspects, features, and advantage of embodiments of the present disclosure will further be appreciated when considered with reference to the following description of embodiments and accompanying drawings. In describing embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

DETAILED DESCRIPTION

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions. Additionally, recitations of steps of a method should be understood as being capable of being performed in any order unless specifically stated otherwise. Furthermore, the steps may be performed in series or in parallel unless specifically stated otherwise.

Figure 1:
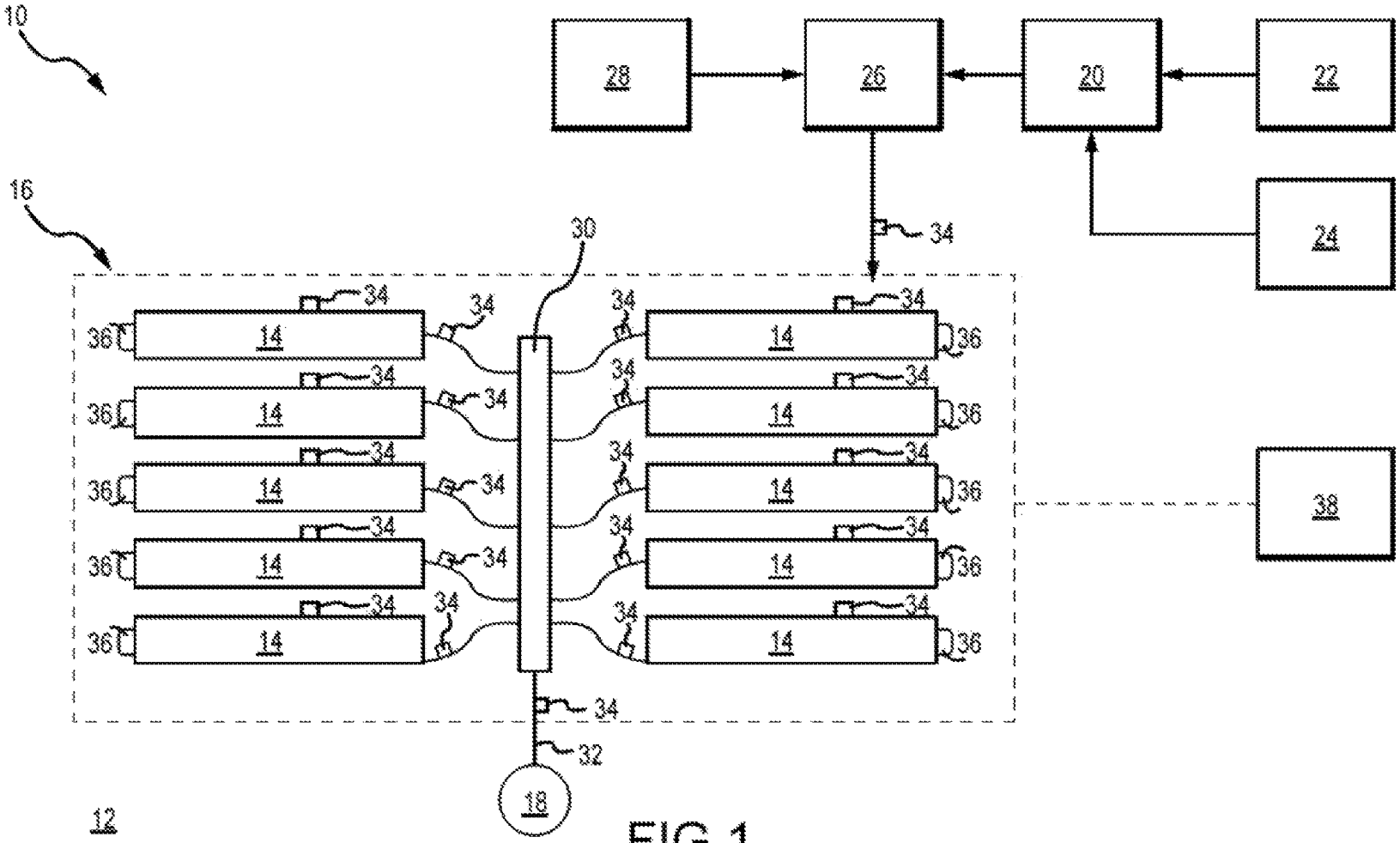
FIG. 1 is a schematic plan view of an embodiment of an automated hydraulic fracturing operation, in accordance with embodiments of the present disclosure.

FIG. 1 is a schematic representation of an embodiment of a hydraulic fracturing system 10 positioned at a well site 12. In the illustrated embodiment, pump trucks 14, which make up a pumping system 16, are used to pressurize a fracturing fluid solution for injection into a wellhead 18. A hydration unit 20 receives fluid from a fluid source 22 via a line, such as a tubular, and also receives additives from an additive source 24. In an embodiment, the fluid is water and the additives are mixed together and transferred to a blender unit 26 where proppant from a proppant source 28 may be added to form the fracturing fluid solution (e.g., fracturing fluid) which is transferred to the pumping system 16. The pump trucks 14 may receive the fracturing fluid solution at a first pressure (e.g., 80 psi to 100 psi) and boost the pressure to around 15,000 psi for injection into the wellhead 18. In certain embodiments, the pump trucks 14 are powered by electric motors.

After being discharged from the pump system 16, a distribution system 30, such as a missile, receives the fracturing fluid solution for injection into the wellhead 18. The distribution system 30 consolidates the fracturing fluid solution from each of the pump trucks 14 (for example, via common manifold for distribution of fluid to the pumps) and includes discharge piping 32 (which may be a series of discharge lines or a single discharge line) coupled to the wellhead 18. In this manner, pressurized solution for hydraulic fracturing may be injected into the wellhead 18. In the illustrated embodiment, one or more sensors 34, 36 are arranged throughout the hydraulic fracturing system 10. In embodiments, the sensors 34 transmit flow data to a data van 38 for collection and analysis, among other things.

Figure 2:
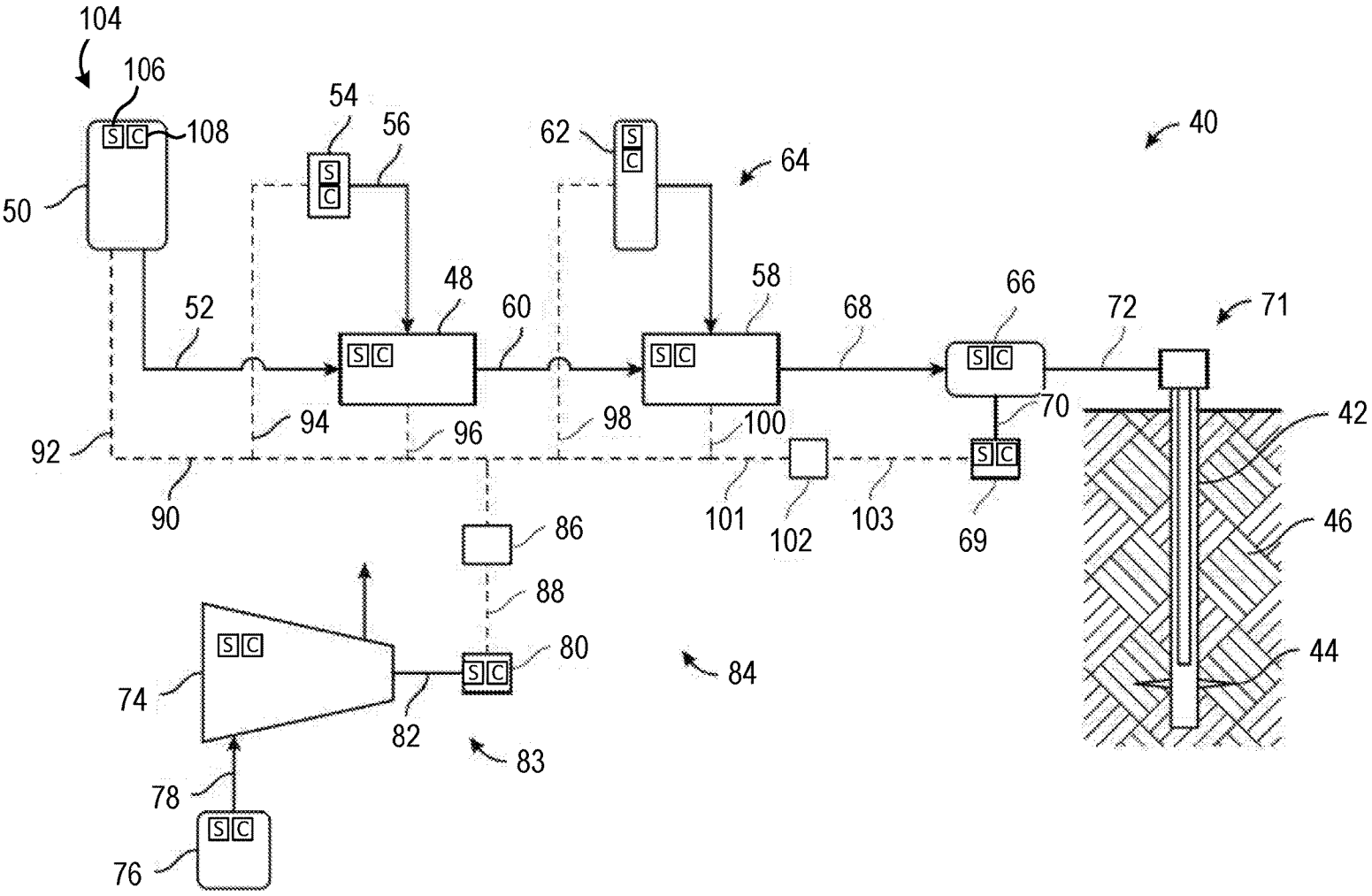
FIG. 2 is a schematic diagram of an embodiment of an automated hydraulic fracturing system, in accordance with embodiments of the present disclosure.

FIG. 2 is a detailed schematic representation of an automated hydraulic fracturing system 40, that can be used for pressurizing a wellbore 42 to create fractures 44 in a subterranean formation 46 that surrounds the wellbore 42. Included with the system 40 is a hydration unit 48 that receives fluid from a fluid source 50 via line 52, and also selectively receives additives from an additive source 54 via line 56. Additive source 54 can be separate from the hydration unit 48 as a stand-alone unit, or can be included as part of the same unit as the hydration unit 48. The fluid, which in one example is water, is mixed inside of the hydration unit 48 with the additives. In an embodiment, the fluid and additives are mixed over a period of time, to allow for uniform distribution of the additives within the fluid. In the example of FIG. 2, the fluid and additive mixture is transferred to a blender unit 58 via line 60. A proppant source 62 contains proppant, which is delivered to the blender unit 58 as represented by line 64, where line 64 can be a conveyer. Inside the blender unit 58, the proppant and fluid/additive mixture are combined to form a fracturing fluid, which is then transferred to a fracturing pump system 66 via line 68; thus fluid in line 68 includes the discharge of blender unit 58 which is the suction (or boost) for the fracturing pump system 66.

Blender unit 58 can have an onboard chemical additive system, such as with chemical pumps and augers. Optionally, additive source 54 can provide chemicals to blender unit 58; or a separate and standalone chemical additive system (not shown) can be provided for delivering chemicals to the blender unit 58. In an example, the pressure of the fracturing fluid in line 68 ranges from around 80 psi to around 100 psi. The pressure of the fracturing fluid can be increased up to around 15,000 psi by pump system 66. A motor 69, which connects to pump system 66 via connection 40, drives pump system 66 so that it can pressurize the fracturing fluid. In one example, the motor 69 is controlled by a variable frequency drive ("VFD").

After being discharged from pump system 66, fracturing fluid is pumped into a wellhead assembly 71. Discharge piping 42 connects discharge of pump system 66 with wellhead assembly 71 and provides a conduit for the fracturing fluid between the pump system 66 and the wellhead assembly 71. In an alternative, hoses or other connections can be used to provide a conduit for the fracturing fluid between the pump system 66 and the wellhead assembly 71. Optionally, any type of fluid can be pressurized by the fracturing pump system 66 to form injection fracturing fluid that is then pumped into the wellbore 42 for fracturing the formation 44, and is not limited to fluids having chemicals or proppant.

An example of a turbine 74 is provided in the example of FIG. 1. The turbine 74 can be gas powered, receiving a combustible fuel from a fuel source 76 via a feed line 78. In one example, the combustible fuel is natural gas, and the fuel source 76 can be a container of natural gas or a well (not shown) proximate the turbine 74. Combustion of the fuel in the turbine 74 in turn powers a generator 80 that produces electricity. Shaft 82 connects generator 80 to turbine 74. The combination of the turbine 74, generator 80, and shaft 82 define a turbine generator 83. In another example, gearing can also be used to connect the turbine 74 and generator 80.

An example of a micro-grid 84 is further illustrated in FIG. 2, and which distributes electricity generated by the turbine generator 83. Included with the micro-grid 84 is a transformer 86 for stepping down voltage of the electricity generated by the generator 80 to a voltage more compatible for use by electrically powered devices in the hydraulic fracturing system 40. In another example, the power generated by the turbine generator and the power utilized by the electrically powered devices in the hydraulic fracturing system 10 are of the same voltage, such as 4160 V, so that main power transformers are not needed. In one embodiment, multiple 3500 kVA dry cast coil transformers are utilized. Electricity generated in generator 80 is conveyed to transformer 86 via line 88. In one example, transformer 86 steps the voltage down from 13.8 kV to around 600 V. Other step down voltages can include 4,160 V, 480 V, or other voltages.

The output or low voltage side of the transformer 56 connects to a power bus 90, lines 92, 94, 96, 98, 100, and 101 connect to power bus 90 and deliver electricity to electrically powered components of the system 40. More specifically, line 92 connects fluid source 20 to bus 90, line 94 connects additive source 24 to bus 90, line 96 connects hydration unit 18 to bus 90, line 98 connects proppant source 62 to bus 90, line 100 connects blender unit 28 to bus 90, and line 101 connects bus 90 to an optional variable frequency drive ("VFD") 102. Line 103 connects VFD 102 to motor 69. In one example, VFD 102 can be used to control operation of motor 69, and thus also operation of pump 66.

In an example, additive source 54 contains ten or more chemical pumps for supplementing the existing chemical pumps on the hydration unit 48 and blender unit 58. Chemicals from the additive source 54 can be delivered via lines 56 to either the hydration unit 48 and/or the blender unit 58. In one embodiment, the elements of the system 40 are mobile and can be readily transported to a wellsite adjacent the wellbore 42, such as on trailers or other platforms equipped with wheels or tracks.

In the illustrated embodiment, one or more instrumentation devices 104 such as various types of sensors 106 and controllers 108 are arranged throughout the hydraulic fracturing system 40 and coupled to one or more of the aforementioned components, including any of the wellhead assembly 71, pump 66, blender unit 58, proppant source 62, hydration unit 48, additive source 54, fluid source 50, generator 80, turbine 74, fuel source 76, any deliveries lines, and various other equipment used in the hydraulic fracturing system 40, not all of which are explicitly described herein for sake of brevity. The instrumentation 104 may include various sensors, actuators, and/or controllers, which may be different for different components. For example, the instrumentation devices 104 may include hardware features such as, low pressure transducer (low and high frequency), high pressure transducers (low and high frequency), low frequency accelerometers, high frequency accelerometers, temperature sensors, external mounted flow meters such as doppler and sonar sensors, magnetic flow meters, turbine flow meters, proximity probes and sensors, speed sensors, tachometers, capacitive, doppler, inductive, optical, radar, ultrasonic, fiber optic, and hall effect sensors, transmitters and receivers, stroke counters, GPS location monitoring, fuel consumption, load cells, PLCs, and timers. In some embodiments, the instrumentation devices may be installed on the components and dispersed in various locations.

The components may also include communication means that enable all the sensor packages, actuation devices, and equipment components to communicate with each other allowing for real time conditional monitoring. This would allow equipment to adjust rates, pressure, operating conditions such as engine, transmission, power ends RPMs, sand storage compartment gates, valves, and actuators, sand delivery belts and shoots, water storage compartments gates, valves, and actuators, water delivery lines and hoses, individual fracture pump's rates as well as collective system rates, blender hydraulics such as chemical pumps, liquid and dry, fan motors for cooling packages, blender discharge pumps, electric and variable frequency powered chemical pumps and auger screws, suction and discharge manifold meters, valves, and actuators. Equipment can prevent failures, reduce continual damage, and control when it is allowed and not allowed to continue to operate based on live and continuous data readings. Each component may be able to provide troubleshooting codes and alerts that more specifically narrow down the potential causes of issues. This allows technicians to more effectively service equipment, or for troubleshooting or other processes to be initialized automatically. Conditional monitoring will identify changes in system components and will be able to direct, divert, and manage all components so that each is performing its job the most efficiently In some embodiments, the sensors may transmit data to a data van 38 for collection and analysis, among other things. In some embodiment, the sensors may transmit data to other components, to the central processing unit, or to devices and control units remote from the site. The communications between components, sensors, and control devices may be wired, wireless, or a combination of both. Communication means may include fiber optics, electrical cables, WiFi, Bluetooth, radio frequency, and other cellular, nearfield, Internet-based, or other networked communication means.

The features of the present disclosure may allow for remote monitoring and control from diverse location, not solely the data van 68. Fracturing control may be integrated in with the sensor and monitoring packages 104 to allow for automated action to be taken when/if needed. Equipment may be able to determine issues or failures on its own, then relay that message with a specified code and alarm. Equipment may also be in control to shut itself down to prevent failures from occurring. Equipment may monitor itself as well as communicate with the system as a whole. This may allow whole system to control equipment and processes so that each and every component is running at its highest efficiency, sand, water, chemical, blenders, pumps, and low and high pressure flow lines. Features of the present disclosure may capture, display, and store data, which may be visible locally and remotely. The data may be accessible live during the data collection and historical data may also be available. Each component to this system can be tested individually with simulation as well as physical function testing.

Operating efficiencies for each individual component and the system 40 may be greatly improved. For example, sand storage and delivery to the blender can be monitored with load cells, sonar sensors and tachometers to determine storage amounts, hopper levels, auger delivery to the tub. Pump efficiencies may be monitored with flow sensors, accelerometers, pressure transducer and tachometers to optimize boost and rate while minimizing harmful conditions such as cavitation or over rating. Failure modes such as wash outs, cutting, valve and/or seat failures, packing issues and supply blockage can be captured and then prevented. Flow lines, both suction supply and discharge can be monitored with flow meters to distribute and optimize flow rates and velocities while preventing over pumping scenarios. Feedback loops of readings from blender to supply manifolds and to pumps can work with each other to optimize pressure and flow. Dropping out of an individual pump may occur preventing further failures, when this occurs the system as a whole may automatically select the best pumps to make up that needed rate. These changes and abilities solve equipment issues and prevent down time as well as provide a means to deliver a consistent job.

In some embodiments, instrumentation devices 104 (any of the above described, among others) can be imbedded, mounted, located in various locations such as in line with flow vessels like hoses, piping, manifolds, placed one pump components such as fluid ends, power ends, transmission, engines, and any component within these individual pieces, mounted external to piping and flow vessels, mounted on under or above sand and water storage containers. Blender hoppers could be duel equipped with hopper proximity level sensors as well as a load cell to determine amount of sand in the hopper at any given time.

Figure 3:
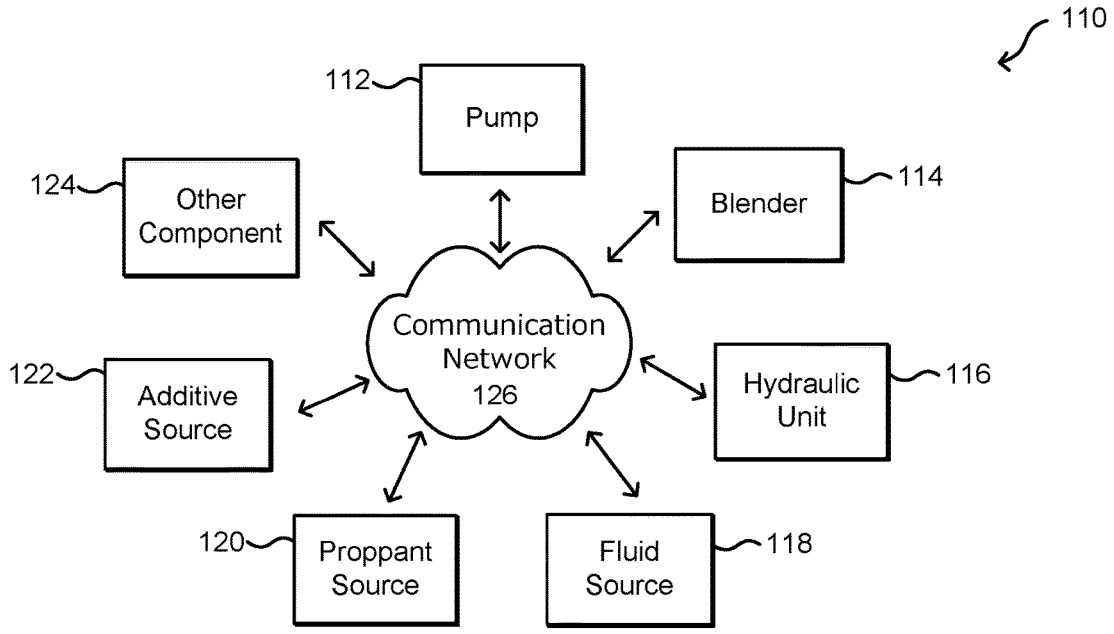
FIG. 3 is a diagram of communicative components of an automated hydraulic fracturing system, in accordance with embodiments of the present disclosure.

FIG. 3 includes a diagram 110 illustrating a connected automated fracturing system, in accordance with various embodiments. In this example, one or more components 42 of a fracturing system, such as a pump 112, blender 114, hydration unit 116, fluid source 118, proppant source 120, additive source 122, and one or more other components 124, may include communication devices for transmitting and receiving data with each other over a communication network 126. In some embodiments, at least some of the components include processors that analyze the data received from one or more of the other components and automatically controls one or more aspects of that component. The communication network 110 may include various types of wired or wireless communication protocols, or a combination of wired and wireless communications. In some embodiments, the connected automated fracturing system further includes one or more of a plurality of components including a manifold, a manifold trailer, a discharge piping, flow lines, conveyance devices, a turbine, a motor, a variable frequency drive, a generator, or a fuel source. Sensors and control devices may be integrated into the one or more of these components, allowing these components to communicate with the rest of the system.

Figure 4:
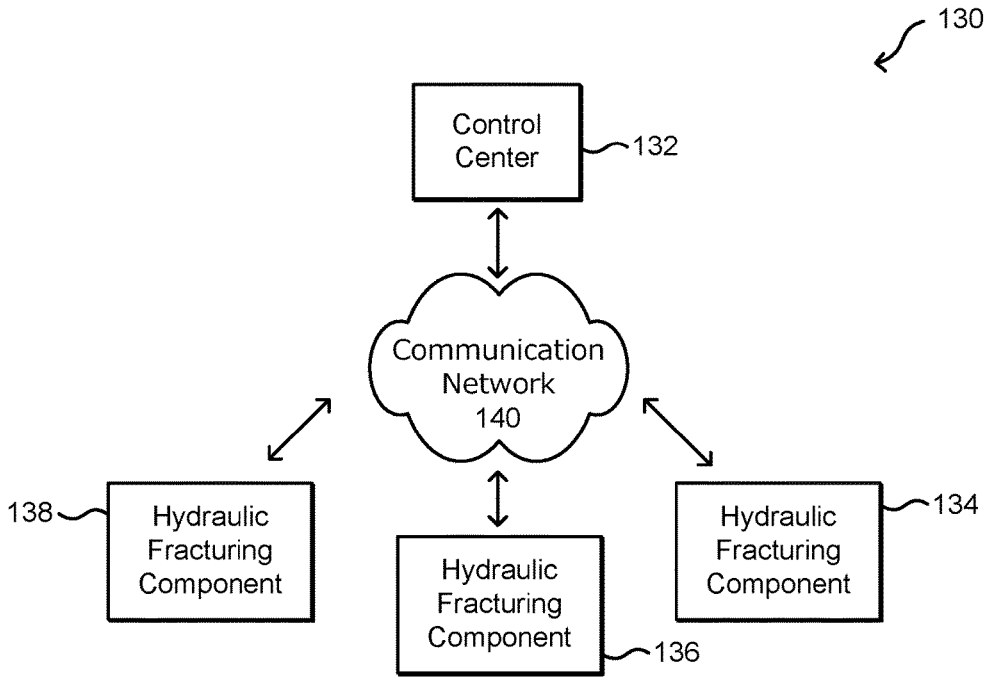
FIG. 4 is a diagram of communicative components of an automated hydraulic fracturing system with a central control center, in accordance with embodiments of the present disclosure.

FIG. 4 includes a diagram 130 illustrating a communications network of the automated fracturing system, in accordance with various embodiments. In this example, one or more hydraulic fracturing components 138, such as, and not limited to, any of those mentioned above, may be communicative with each other via a communication network 140 such as described above with respect to FIG. 3. The components 138 may also be communicative with a control center 132 over the communication network 140. The control center 132 may be instrumented into the hydraulic fracturing system or a component. The control center 132 may be onsite, in a data van, or located remotely. The control center 132 may receive data from any of the components 138, analyze the received data, and generate control instructions for one or more of the components based at least in part on the data. For example, the control center 132 may control an aspect of one component based on a condition of another component. In some embodiments, the control center 140 may also include a user interface, including a display for displaying data and conditions of the hydraulic fracturing system. The user interface may also enable an operator to input control instructions for the components 134. The control center 140 may also transmit data to other locations and generate alerts and notification at the control center 140 or to be received at user device remote from the control center 140.

Figure 5:
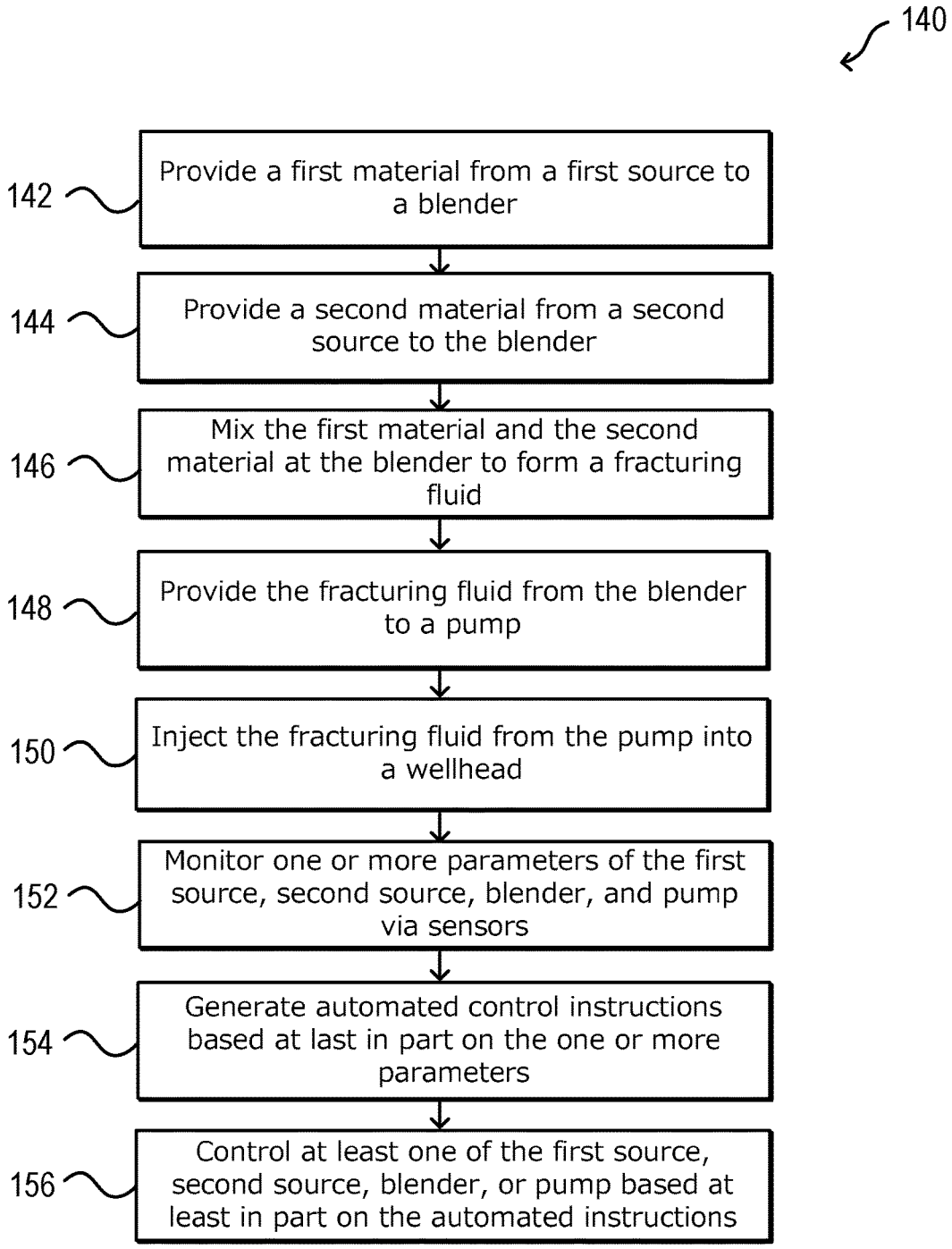
FIG. 5 is a flow chart of an embodiment of an automated hydraulic fracturing method, in accordance with embodiments of the present disclosure.

FIG. 5 is a flow chart of an embodiment of an automated hydraulic fracturing method 140, in accordance with example embodiments. It should be noted that the method may include additional steps, fewer steps, and differently ordered steps than illustrated in this example. In this example, a hydraulic fracturing operation is initiated 142 using an automated hydraulic fracturing system. A first material for a fracturing fluid is provided 144 from a first source to a blender. The first source includes a sensor for measuring one or more parameters associated with the first source and a controller for controlling one or more functions of the first source. A second material for the fracturing fluid is provided from a second source to the blender. The second source may also be instrumented with a sensor and a controller. The first material and the second material is mixed 146 at the blender to form the fracturing fluid. The blender may also be include a sensor for measuring one or more parameters associated with the blender and a controller for controlling one or more functions of the bender. The fracturing fluid is provided from the blender to a pump, and the pump includes a sensor for measuring one or more parameters associated with the pump and a controller for controlling one or more functions of the pump. The fracturing fluid is then injected 150 from the pump into a wellhead coupled to a well. The one or more parameters are monitored 152 via the sensors on the first source, second source, blender, pump, and various other sensors in the hydraulic fracturing system. Automated instructions can then be generated 154 for at least one of the source controller, the blender controller, or the pump controller based at last in part on the one or more parameters.

At least one of the one or more functions of the first source, the blender, the pump, or other component of the hydraulic fracturing system may be controlled 156 via the respective controller based on the automated control instructions. In some embodiments, the instructions may cause one or more of the control devices to automatically adjust one or more of a flow rate, a pressure, power, motor speed, gates, valve, actuators, delivery lines and conveyance devices, pump rates, or cooling systems. For example, a pump system may include comprises a motor controlled by the pump controller based at least in part on the automated instructions. In some embodiments, the blender includes at least one of a chemical pump, a cooling system, an auger, a blender discharge pump, a valve, or an actuator, any of which may be controlled by the blender controller based at least in part on the automated instructions. In some embodiments, the first or second source may include at least one of a gate, a valve, an actuator, a delivery belt, a delivery line, or a chemical pump, any one of which may controlled by a source controller based at least in part on the automated instructions. For example, the rate of delivery of a material may be automatically started, stopped, or adjusted based on the automated instructions. The pressure or rate at which the fracturing fluid is injected into the wellhead may be controlled based on the automated instructions.

The hydraulic fracturing system may include other components, such as a turbine, a generator, a hydration unit, a distribution system, a fuel source, or a wellhead, among others. These components may also be instrumented with sensors that measures at least one parameter associated with the turbine, the generator, the hydration unit, the distribution system, the fuel source, or the wellhead. These components may also include controllers, which control at least one aspect of the turbine, the generator, the hydration unit, the distribution system, the fuel source, or the wellhead, based at least in part on the automated instructions. In some embodiments, the hydraulic fracturing system includes a plurality of pumps and a distribution system, in which fracturing fluid is provided from the blender to the plurality of pumps, the fracturing fluid is provided from the plurality of pumps to the distribution system, and the fracturing fluid is injected from the distribution system into the wellbore. The individual pressure at each pump may be automatically adjusted based on the automated instructions. The combined or overall pump rate of the plurality of pumps may also be controlled, and the rate at the distribution system may also be controlled via the automated instructions.

In some embodiments, the method 140 may include detecting that at least one of the one or more parameters is outside of an acceptable threshold and automatically stopping or adjusting one or more functions of the hydraulic fracturing system in response to the detection. In some embodiments, the method 140 may include detecting substandard performance in one or more areas of the automated hydraulic fracturing system, automatically troubleshooting the automated hydraulic fracturing system based on live data from a plurality of sensors or previous data collected by the sensors, determining one or more causes or suspected causes of the substandard performance, and automatically adjusting one or more components of the automated hydraulic fracturing system to resolve the substandard performance. In some embodiments, the system may provide troubleshooting codes or alerts indicative of one or more sources of a performance issue.

Figure 6:
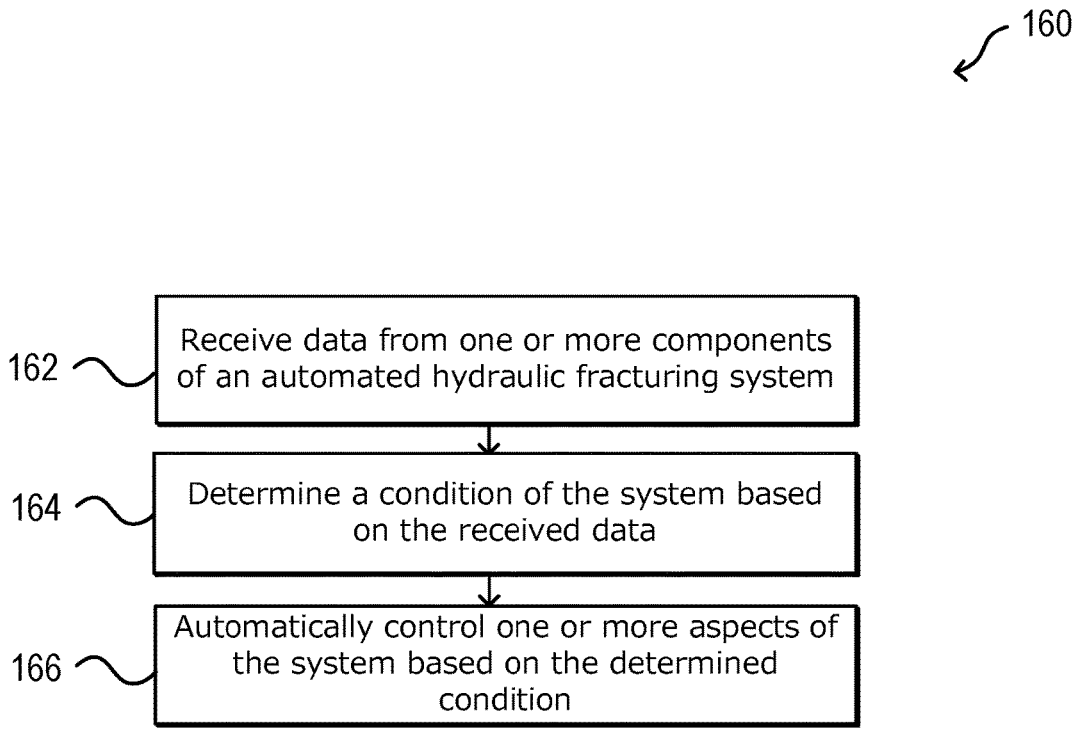
FIG. 6 is a flow chart of an embodiment of a method of controlling an automated hydraulic fracturing system, in accordance with embodiments of the present disclosure.

FIG. 6 illustrates a method 160 of controlling an automated fracturing system, in accordance with various embodiments. In this embodiment, the method 160 includes receiving 162 data from one or more components of an automated fracturing system, such as those described above. The method 160 further includes determining 164 a condition of the system based on the received data. The method further includes controlling 166 one or more aspects of the system based on the determined condition.

Figure 7:
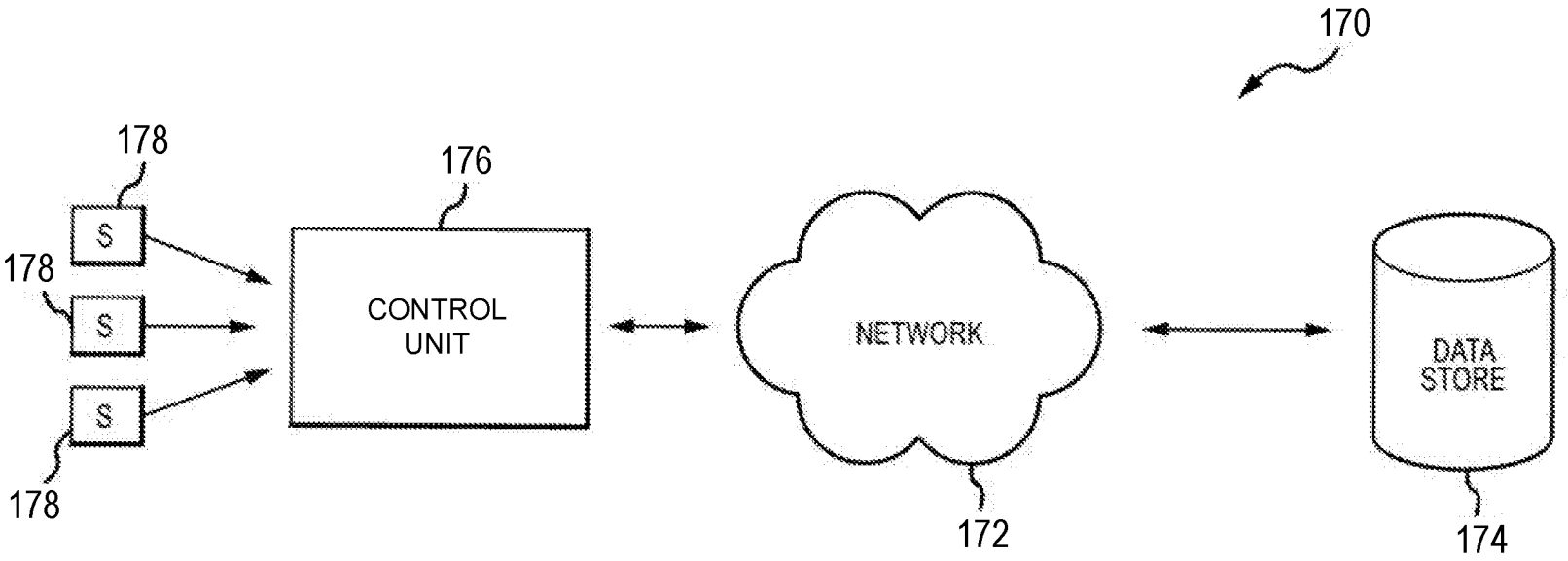
FIG. 7 is a block diagram of an embodiment of a control system of an automated hydraulic fracturing system, in accordance with embodiments of the present disclosure.

FIG. 7 is a block diagram of an embodiment of a control system 170 for receiving, analyzing, and storing information from the well site. As described above, sensors 178 are arranged at the well site and may transmit data to a control unit 176 for evaluation and potential adjustments to operating parameters of equipment at the well site. The control unit 176 may be communicatively coupled to a network 172, such as the Internet, that can access a data store 174, such as a cloud storage server. Accordingly, in embodiments, data from the sensors 178 is transmitted to the control unit 176 (which may be located on a component, within a data van, or remotely) and is stored locally. However, the control unit 176 may upload the data from the sensors 178 along with other data, to the data store 174 via the network 172. Accordingly, data from previous pumping operations or different sensors may be utilized to adjust various aspects of the hydraulic fracturing operation as needed. For example, the flow data from the sensor 178 may be coupled with information from the sensors 178 (such as the vibration sensor, gear sensors, RPM sensors, pressure sensors, etc.) to provide diagnostics with information from the data store 174. For example, previous data may be used as training data for a machine learning model for predicting various control parameters of a present operation. In embodiments, the data store 174 includes information of the equipment used at the well site. It should be appreciated that, in various embodiments, information from the data store 174 may be stored in local storage, for example in storage within a data can, and as a result, communication over the network 172 to the remote data store 174 may not be used. For example, in various embodiments, drilling operations may be conducted at remote locations where Internet data transmission may be slow or unreliable. As a result, information from the data store 174 may be downloaded and stored locally at the data van before the operation, thereby providing access to the information for evaluation of operation conditions at the well site.

The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. An automated hydraulic fracturing method, comprising:

initiating a hydraulic fracturing operation using an automated hydraulic fracturing system;

delivering a fluid from a fluid storage system to a hydration unit;

delivering an additive from an additive storage system to the hydration unit;

mixing the fluid and the additive at the hydration unit to form a fluid mixture;

delivering the fluid mixture from the hydration unit to a blender;

delivering proppant from a proppant storage system to the blender;

mixing the fluid mixture and the proppant at the blender to form a fracturing fluid, the blender comprising a blender sensor for measuring one or more parameters associated with the blender and a blender controller for controlling one or more functions of the bender;

providing the fracturing fluid from the blender to a pump, the pump comprising a pump sensor for measuring one or more parameters associated with the pump and a pump controller for controlling one or more functions of the pump;

injecting the fracturing fluid from the pump into a wellhead coupled to a well;

monitoring one or more parameters of the hydraulic fracturing operation via a plurality of sensing devices integrated into the proppant storage system, the fluid storage system, the additive storage system, the hydration unit, the blender, and the pump;

generating automated instructions for at least one of the sensing and control devices based at last in part on the one or more parameters; and controlling one or more functions of the hydraulic fracturing operation via a plurality of control devices integrated into the proppant storage system, the fluid storage system, the additive storage system, the hydration unit, the blender, and the pump based at least in part on the automated instructions.

2. The method of claim 1, further comprising:

detecting that at least one of the one or more parameters is outside of an acceptable threshold; and automatically stopping or adjusting at least one of the one or more functions in response to the detection.

3. The method of claim 1, further comprising:

detecting substandard performance in one or more areas of the automated hydraulic fracturing system;

automatically troubleshooting the automated hydraulic fracturing system based on live or previously collected data from the sensing devices;

determining one or more causes or suspected causes of the substandard performance; and automatically adjusting one or more components of the automated hydraulic fracturing system to resolve the substandard performance.

4. The method of claim 1, further comprising:

detecting that at least one performance issue of the automated hydraulic fracturing system; and providing troubleshooting codes or alerts indicative of one or more sources of the performance issue.

5. The method of claim 1, further comprising:

transmitting information derived from the one or more parameters to a remote control center;

receiving control instructions from the remote control center; and automatically controlling at least one aspect of the hydraulic fracturing system based at least in part on the received control instructions.

6. The method of claim 1, further comprising:

automatically starting, stopping, or adjusting the rate of delivery of the proppant or fluid mixture to the blender based at least in part on the automated instructions.

7. The method of claim 1, further comprising:

controlling a pressure or rate at which the fracturing fluid is injected into the wellhead based on the automated instructions.

8. The method of claim 1, further comprising:

providing the fracturing fluid from the blender to a plurality of pumps;

providing the fracturing fluid from the plurality of pumps to a distribution system;

injecting the fracturing fluid from the distribution system into the wellbore; and automatically adjusting individual pressures or pump rates of the plurality of pumps and/or a pressure or pump rate of the distribution system based on the automated instructions.

* * * * *